US005195202A

United States Patent [19]

Hamann

[11] Patent Number: 5,195,202

[45] Date of Patent: Mar. 23, 1993

[54] METHOD FOR DYEING TEXTILES

[75] Inventor: Hans-Jorg Hamann, Langenhagen, Fed. Rep. of Germany

[73] Assignee: Kekko-Mode, Langenhagen, Fed. Rep. of Germany

[21] Appl. No.: 713,378

[22] Filed: Jun. 13, 1991

[30] Foreign Application Priority Data

Jun. 13, 1990 [DE] Fed. Rep. of Germany ..... 4018835

[51] Int. Cl.[5] ..... D06B 1/12

[52] U.S. Cl. ..... 8/150; 8/151; 8/158

[58] Field of Search ..... 8/149.1, 150, 151, 158; 68/38, 90, 200, 205 R; 26/25, 27, 28, 29 R, 32, 37

[56] References Cited

U.S. PATENT DOCUMENTS 2,199,093 4/1940 Wolfenden ..... 68/200
2,648,088 8/1953 Bailey ..... 68/200 X
2,820,358 1/1958 Mayner ..... 68/200
4,607,409 8/1986 Hishimuma et al. ..... 26/28 X
4,648,250 3/1987 Yabe ..... 68/205 R X
4,951,366 8/1990 Geller ..... 26/28

FOREIGN PATENT DOCUMENTS 27871 of 1905 United Kingdom ..... 68/205 R

*Primary Examiner*—Philip R. Coe
*Attorney, Agent, or Firm*—Longacre & White

[57] ABSTRACT

The invention concerns a method and apparatus for dyeing textiles wherein simultaneously the surfaces of these textiles are mechanically processed in such manner that wear shall appear and that the fabric softens, making it possible to minimize energy and material expenditures on one hand and ecological stress on the other.

For that purpose the invention provides that the textiles in the form of finished pieces or yard goods are stressed in-line by the bristles of brushes through which simultaneously a dye liquor with a very low proportion of dye of the order of magnitude of approximately 0.01 to 0.05 g/liter is deposited on the textile pieces.

7 Claims, 5 Drawing Sheets

METHOD FOR DYEING TEXTILES

BACKGROUND OF THE INVENTION

1. Field of the Invention

The invention concerns a method for dyeing textiles, whereby simultaneously with dyeing, the textile surfaces are so treated mechanically that wear appears and the fabric is softened.

2. Description of the Prior Art

Known methods of this kind are used in particular for modish garments with washed-out effects, for instance the so-called stone washed jeans.

A method is known wherein either the finished piece or the initial material (yard ware) first is thoroughly dyed and then the color is washed out up to 95% in a wash-and-wear process. The wear effect is achieved simultaneously with the washing step by adding abrasives such as sand and/or emery or the like.

This known method has the drawback of being time-consuming an significantly energy wasteful because the initially introduced dyestuff must be removed again. The known method is also harmful to the environment due to the dye removed from the fabric. Additionally, there is a considerable expenditure of dye and detergents.

Accordingly, it is the object of the invention to create a method of creating stone-washed jeans whereby both the energy and the material consumption as well as the ecological stress shall be minimized.

SUMMARY OF THE INVENTION

In the present invention, the textiles in the form of finished or yard goods are treated in-line by the bristle ends of brushes simultaneously feeding a dye liquor to the textile pieces, with a very low proportion of dye of the order of magnitude of approximately 0.01 to 0.05 g/liter of treating liquor.

On account of the very low proportion of dye required to surface-dye the textile pieces, this method makes it possible to deposit only a very slight amount of the dye liquor on the textile surface, so that the textiles are not even moistened through and through, but instead quickly dry. This means that practically no dye residues need be released into the environment because the amounts of dye that were introduced are fully absorbed by the textiles.

However, the textile pieces may be impregnated with the dye liquor so much that the dyeing shall be formed as well on the textile back, on the textile side away from the brushes. This process can be enhanced by applying steam to the dye liquor, this steam favoring the penetration of and absorption into the textile pieces. This steam is saturated steam as a rule, at a temperature of approximately 100 to 120 degrees Celsius. Any excess dye liquor that might slip past the textile pieces may be appropriately collected and returned to the dye liquor.

In one embodiment of the equipment implementing the method of the invention, driven and rotating brushes appropriately are provided which feed the textile pieces with dye liquor.

Appropriately, the equipment consists of a row of horizontally mounted dye-liquor receptacles with separate discharge ducts rotatably pointing toward brushes mounted underneath the receptacle.

Appropriately at least one conveyor belt supporting the textile pieces moves continuously underneath the brushes.

Especially advantageously, the conveyor belt shall be prestressed against the bristles of the brushes. As a result, not only are the textile pieces dyed by the brushes, but also they are being surface-processed in the manner described above on account of said pre-stressing.

The conveyor belt is comprised of an elastic material in which there are interruptions so that the excess dye liquor can pass through these interruptions and arrive in a receptacle below the conveyor belt. In particular, the conveyor belt may be a rubber band, especially a fiber-reinforced rubber.

It is advantageous to so design the equipment s that the top and back sides of the textile pieces can be processed in the same manner in one operational procedure. Appropriately, a reversing device and also a second conveyor belt below the first one are provided for that purpose, said second belt also being stressed by brushes mounted above the second belt. Accordingly, the textile pieces are moved from the first conveyor belt into the reversing device and then are seized by the second conveyor belt and are pulled a second time through the equipment. The reversing device may be a metal guide moving the textile pieces to the second conveyor belt.

In a preferred embodiment, the individual receptacles communicate by their outlets with at least one steam conduit, the supply duct of the dye liquor to the brushes simultaneously also being able to feed steam, whereby impregnation is carried out. In yet another preferred embodiment, at least one compressed-air line is present in the receptacles and comprises discharge apertures facing the inside space of the individual receptacles in order to make the dye liquor swirl and to keep it in motion to prevent dye components from settling.

The supply ducts of the dye liquor can be shut off individually, with corresponding shutoff valves being mounted in the immediate vicinity of the brushes. These supply ducts also may be equipped with a bypass shunting the dye liquor past the valves and feeding it to the second row of processing brushes associated with the second conveyor belt, so that it is possible to bypass the shut-down valves.

Steam may be appropriately supplied by means of a steam nozzle, prior to processing the back side of the textile pieces, to the brushes in the vicinity of the metal guide, whereby the back side of the textile piece being treated also shall be steam-moistened.

The equipment of the invention can be used in the most diverse manner. Illustratively the dye intensity in the individual receptacles may be different; or different dyes may be present in the individual receptacles, and the valves may be set in such manner that no dye, or different amounts of dye, arrive at the brushes.

The receptacles may be heated, and the temperatures in the individual receptacles may differ, whereby different absorption rates of the dye liquor ensue.

The spacings of the brush shafts to the conveyor belts can be adjusted, whereby the pre-stressing implementing the wear-processing of the textiles will be changed.

All the brushes can be provided with a common drive, such as a chain drive, so that a single drive motor suffices to power the brushes.

Intermediate brushes of lesser diameters can be mounted between the main brushes of comparatively large diameters and need not necessarily serve to deposit dye but may be used merely for the wear-processing of the textile surfaces.

The conveyor belts may be divided into parts or else the brushes may operate at different speeds, as a result of which folds will appear in the textile pieces that shall be worn especially hard by the brushes. For the same reason it is possible to provide further intermediate brushes rotating in the opposite direction to the main brushes which determine the direction advance.

A further set of brushes in each row of brushes may be used as a depressing means.

An adding system may be provided, whereby the pigments are fed with simultaneous pressurization through dye nozzles to the revolving brushes and/or to the textiles being processed. The adding system comprises several nozzles and at least one supply duct to feed saturated steam and/or heating steam to the steam nozzles.

In the process, the dye nozzles also may be loaded by a compressed-air line and/or by the steam conduits.

Appropriately a receptacle holding the dye may be associated to the compressed-air line and assume the shape of a venturi tube to remove dye particles.

In particular, several addition systems mounted next to each other may also be provided to feed about 15 controlled systems of brushes.

Another embodiment of the equipment implementing the method of the invention consists of the depressing brushes—which are mounted between the processing brushes and evince a diameter substantially less than that of the processing brushes. The depressing brushes are not bristle-brushes as in the previous embodiment but instead are sponge-brushes comprising a tubular cylindrical molded article pulled onto a shaft to which it adheres by gluing or the like.

Using such sponge-brushes offers the advantage that because of the higher adhesion to the textile piece, crumpled zones are created which are deposited in a pattern forming or streak-forming manner on the textile piece and which evince more dyeing than around them. To achieve such an effect, the sponge-brushes as a rule are not used as wear-inducing tools, but instead as crumpling and depositing brushes for the dyes. The scope of crumpling also includes squeegee-ing because on account of the compression of the textile piece in the pleated zone there will be more dye deposition and thereby reproduction of the pattern so achieved.

The spongy depressing brushes shall be able to be movably adjusted forwardly, rearwardly, upwardly and downwardly relative to the neighboring brushes, with the shafts bearing the sponges also being adjustable in height relative to the surface of the conveyor belt. If the shaft is moved closer to the conveyor belt, the cylindrical spongy coat shall be compressed more in that region, which means simultaneously higher pressure on the textile piece in this region resulting in deviating patterns.

These sponge roll brushes are followed by bristle-brush rolls and which in part dissolve the fairly well defined contours of the squeezed pleats or the like that were produced by the sponges, the magnitude of this dissolution depending on the number of bristle-brushes that follow.

However, the contour deposited by the sponges is much more visible than that created in the first embodiment by means of bristle-brushes, so that as regards the contour deposited in the sponge embodiment, the deposited contour in every case and in spite of dissolution by the ensuing bristle-brushes shall be substantially retained.

As was the case for the depressing brushes of the first embodiment, the spongy roll brushes also may run in the opposite direction of the adjacent bristle-brush rolls, so as to achieve further dissolution of the contour on account of the entailed relative motion.

In lieu of being guided by the conveyor belt, the textile pieces also may be guided by means of the brushes on a smooth and plane slide surface, their advance being implemented by the main brushes acting in the direction of advance. This main advance is left unaffected by the presence of individual brushes moving in the opposite direction such as the depressing brushes or the spongy roll brushes, because the advance forces exerted by the main brushes in any event are a multiple of the forces applied by the sponge-brush rolls rotating in the opposite direction.

This slide surface may consist of a polished special steel, of a smooth, wear-proof plastic or the like, so that the displacement of the textile pieces along this surface will not be hampered.

To recover the dye, the slide surface may comprise downward-pointing apertures through which the excess dye or the excess dyeing material (the dye liquor) can drip off to be collected there.

The dye liquor so evacuated can be returned at the upper region of the equipment to the dye-liquor receptacle.

Besides the patterns generated by squeegee-ing o crumpling the textile pieces, specified types of patterns also may be formed by physically affixing patterns on the surface of the spongy brush roll—for instance by gluing or by means of a net passing over the entire spongy brush roll and keeping pattern segments on this roll. Such a net furthermore offers the simultaneous advantage that at home the contour that must be generated by the pattern will appear to be dissolved. The pattern segment may consist of a textile, a flexible plastic, or a flexible metallic material.

Another way to make a pattern is by having recesses in the surfaces of the spongy roll brushes, such as millings, forming the pattern contours.

The net pulled over the pattern segments and the sponge rolls also may be a textile, for instance a coarse-mesh fabric, of which the meshes are reproduced as a pattern on the textile piece being dyed.

The equipment of the invention achieves much better results than the known methods, of which it avoids the high ecological stress. Moreover the known method uses as much as 50 times more dye, further great quantities of chemicals, bleaches and abrasives, and in spite of intensive rinsing of 70 liters per part, such abrasives cannot be all flushed out of the fabric.

Because jeans and leisure wear are made almost all without linings, the fabrics so dyed make constant skin contact which, in the light of the above residues in the textiles, may lead to skin disease and allergies.

As regards the equipment of the invention, on the other hand, the use of the above cited chemicals and abrasives is almost entirely eliminated and therefore rinsing no longer is required. The method implemented by the equipment of the invention additionally requires no waste disposal and is correspondingly skin-compatible.

In the inventive method, the fabric is dyed step-wise and layer-wise only up to the desired dyeing stage thus eliminating ecology-stressing operational procedure wherein any base dyeing must be washed out.

Compared to the degree of abrasion of the known techniques, wherein abrasives are added to the washing cycles, the brush-technique basic to the invention achieves substantially higher softness, whereby the fabrics are comparatively more supple. There are substantial savings in materials, energy, labor and waste-removal costs, resulting in substantially higher competitiveness. Costs regarding waste removal shall rise in the future very substantially on account of legal decisions, and as a result a further competitive advantage accrues to the invention which does not involve waste removal.

Additionally, the equipment of the invention makes it possible to manufacture differently dyed textiles or garments in a single operational procedure.

Because material such as silk cannot be co-processed in the known methods, they must be sewed on subsequently, incurring higher cost and interrupting the homogeneous dyeing of the garment. In view of the brush technique of the invention, such materials can be co-processed without damage to them as would occur by the known techniques.

DETAILED DESCRIPTION OF THE DRAWINGS

Figure 1:
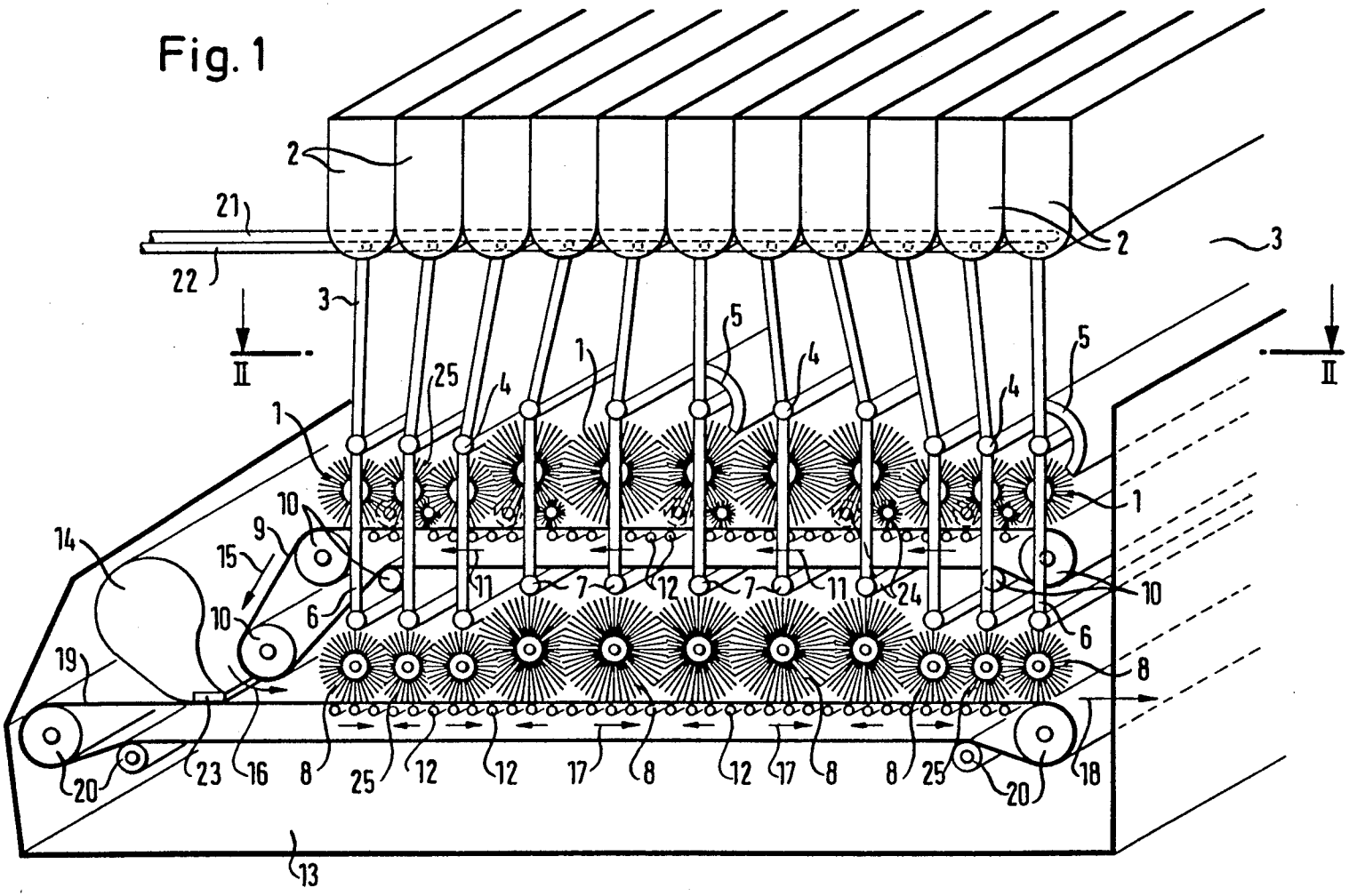
FIG. 1 is a schematic perspective view of the equipment for implementing the method of the invention.
Figure 2:
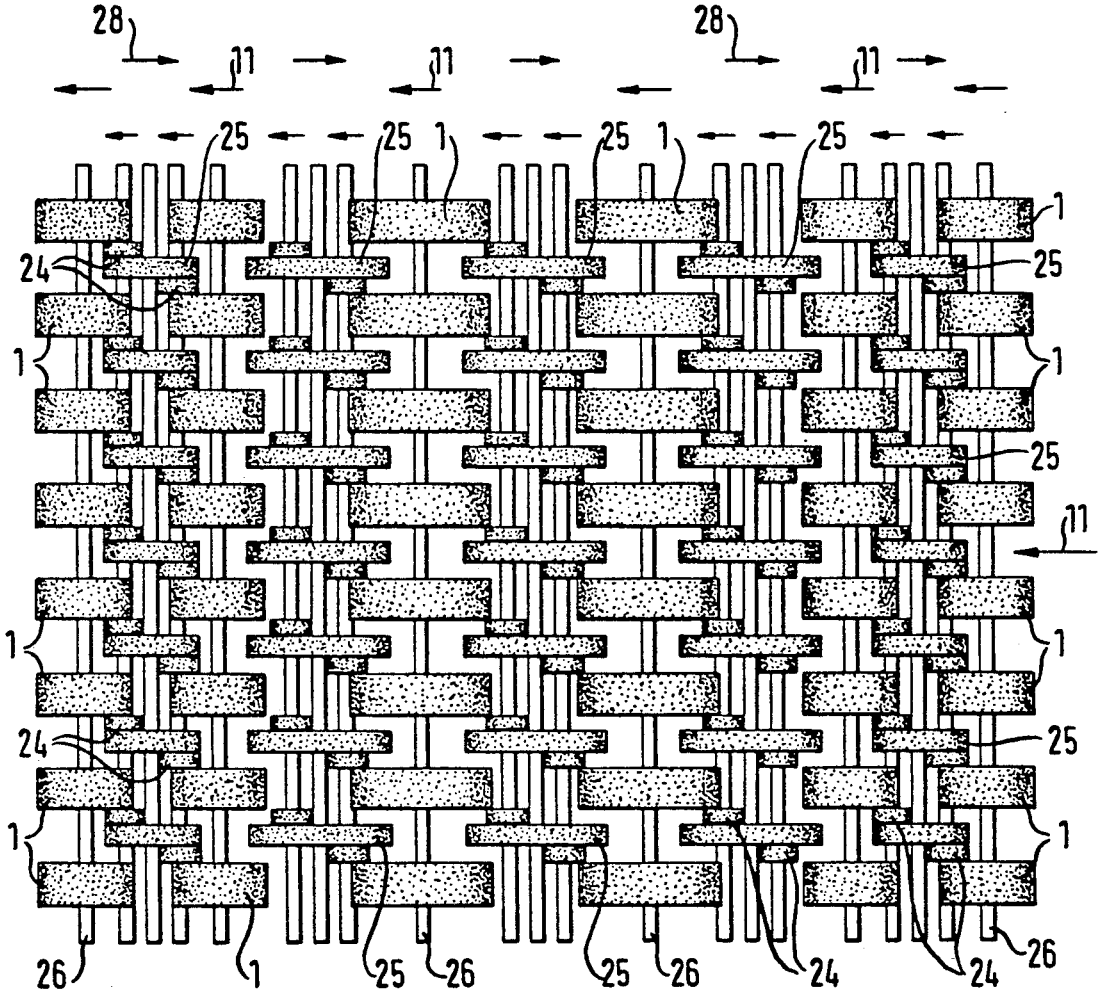
FIG. 2 is an overhead view II/II of the rotating brushes.

As shown by FIGS. 1 and 2, several driven and rotating brushes 1 are present, which deposit the dye liquor on the textiles being processed. The dye liquor is present in a row of receptacles 2 each with a discharge duct 3 in the form of long ducts or conduits pointing to the bristles of the brushes 1 mounted below the receptacle 2. The perspective representation of the receptacles 2, discharge ducts 3 and brushes 1 is indicated merely schematically in FIG. 1 for the sake of clarity.

The dye-liquor discharge ducts 3 can be individually shut down by shutoff valves 4 mounted in the immediate vicinity of the surfaces of the brushes 1. Furthermore, the discharge ducts 3 can comprise a bypass 5 shunting the dye liquor past the valves 4 to a second row of discharge ducts 6 with valves 7 through which it feeds a second row of brushes 8.

A driven conveyor belt 9 passing on rollers 10 revolves underneath the brushes 1 and by its upper segment moves in the direction of the arrows 11. This kind of direction of motion also is shown in FIG. 2 by the arrow 11. The textile pieces being processed therefore are introduced at the right of FIGS. 1 and 2 into the equipment above the conveyor belt 9 and are processed in the described manner by the rotating brushes 1 resting pre-stressed against this conveyor belt. The dye liquor is fed through the supply ducts 3 and the brushes 1 to the textile pieces which furthermore are mechanically processed at their surface by the said pre-stressing.

In the region of its upper segment the conveyor belt 9 comprises known small support rollers 12 whereby the pre-stressing is maintained over the entire length of the conveyor belt.

The conveyor belt 9 consists of an elastic material comprising interruptions in it so that the excess dye liquor can pass downward into a collecting pan 13 mounted underneath the conveyor belt 9.

In order that the back side of the textile pieces may be processed in the same operational procedure, a reversing device in the form of a metal guide 14 is provided which feeds the unilaterally processed textile pieces discharged from the first set of brushes 1 in the direction of the arrow 15 to the second set of brushes 8. The textile pieces are deflected by the metal guide 14 in the direction of the arrow 16. Thereupon they move past the second set of brushes in the direction of the arrow 17 and are discharged at 18. The design of the lower conveyor belt 19 guided by means of rollers 20 and of which the upper segment also is forced by support rollers 12 against the brushes 8 corresponds to the design of the upper conveyor belt 9.

The individual receptacles 2 communicate in the region of their discharges with a steam conduit 21, whereby steam also may be fed to the brushes 1 and 8 through the discharge duct 3 for the dye liquor. Moreover, each receptacle 2 may include a compressed-air line 22 with outlets facing the insides of the individual receptacles, so that air can be blown into the receptacles to swirl the dye liquor and to keep it agitated.

At least one steam nozzle 23 may be provided in the vicinity of the metal guide 14, SO that following reversal of motion also the back side of the textile pieces being processed shall be steam-penetrated. The distance of the brush axes from the conveyor belts 9 and 19 may be adjustable, so that the pre-stressing between the bristles and the conveyor belt surface can be changed.

As shown by FIG. 2 the main brushes 1, which are used mainly for processing, are mounted both next to each other on common shafts 26 and also behind each other. Smaller brushes 24 can be mounted in the resulting gaps, and where called for will not be used for dye deposition but merely for wear-treatment of the textile surfaces. These intermediate brushes 24 moreover can serve—as described above—as depressing means for the textiles, in order to prevent same from being pulled upward or being shifted.

Lastly further intermediate brushes 25 may be provided, which rotate in the direction opposite of the main brushes 1 determining the direction of advance and thereby create folds that will be subjected to special wear by the brushes.

The processing direction of these brushes therefore is opposite that of the brushes 1; the direction of action thus corresponds to the arrows 28.

Figure 3:
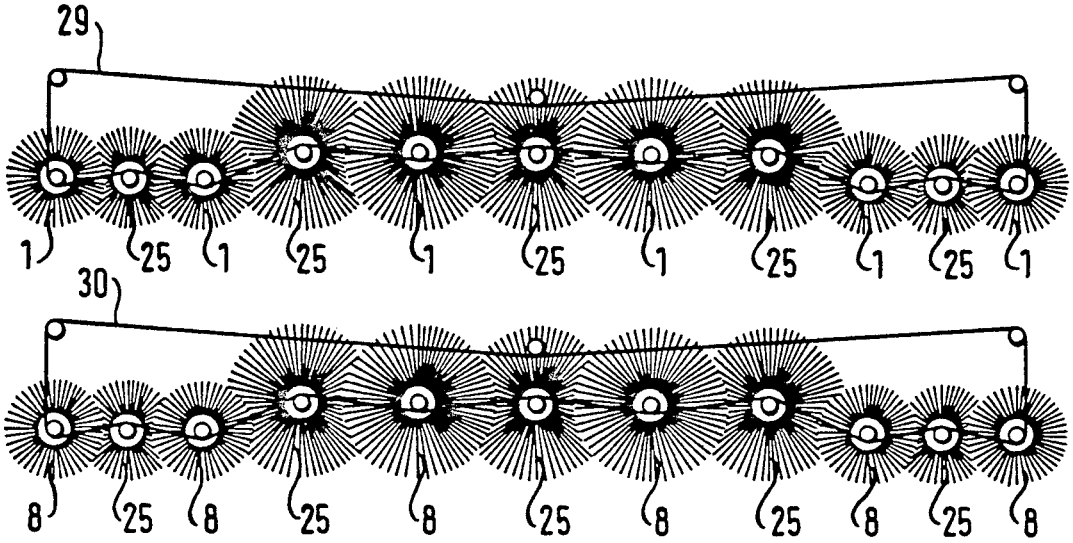
FIG. 3 is an elevated view of the sets of brushes to process the textiles, and their drive.

FIG. 3 shows schematically the sets of brushes 1 and 8 and their common drive 29 and 30, which is illustrated as a chain drive. The drives 29 and 30 power the intermediate brushes 25 too, which are shown herein and rotate in the opposite direction, by the drive being common and suitably steered. The forces that can be transmitted from the oppositely rotating intermediate brushes 25 to the textiles may be about 25% of the total force applied to these textiles.

The drive speed can be controlled continuously so that the brushes 1 of the upper set of brushes can rotate at speeds different from those of the brushes 1 of the lower set of brushes.

Figure 4:
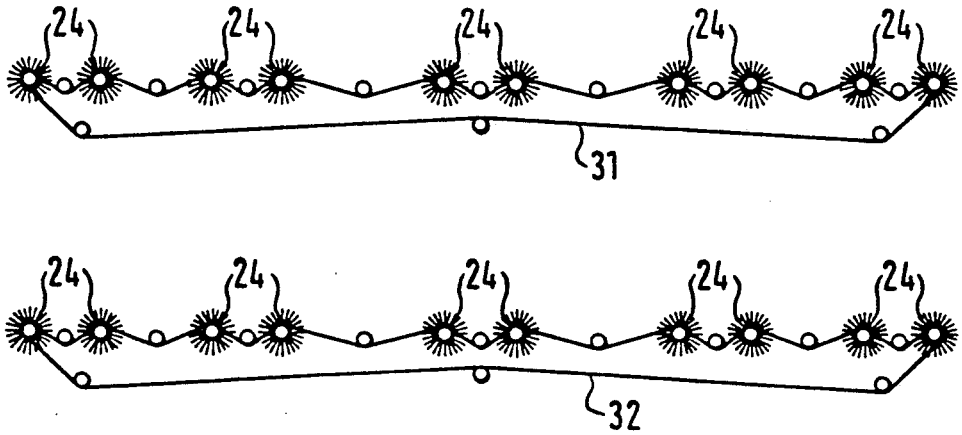
FIG. 4 is an elevated view of the depressing means which are axially parallel to the processing brushes and which themselves may be brushes.

FIG. 4 schematically shows the small intermediate brushes 24 (also see FIG. 2) serving as depressing means for the upper and lower sets of brushes of the equipment. These intermediate brushes 24 also may be equipped with chain drives 31 and 32 which in turn also may be controlled. The intermediate brushes 24 and 25 (FIG. 2) together with their drives may be detachably mounted as one unit between the main brushes 1.

Figure 5:
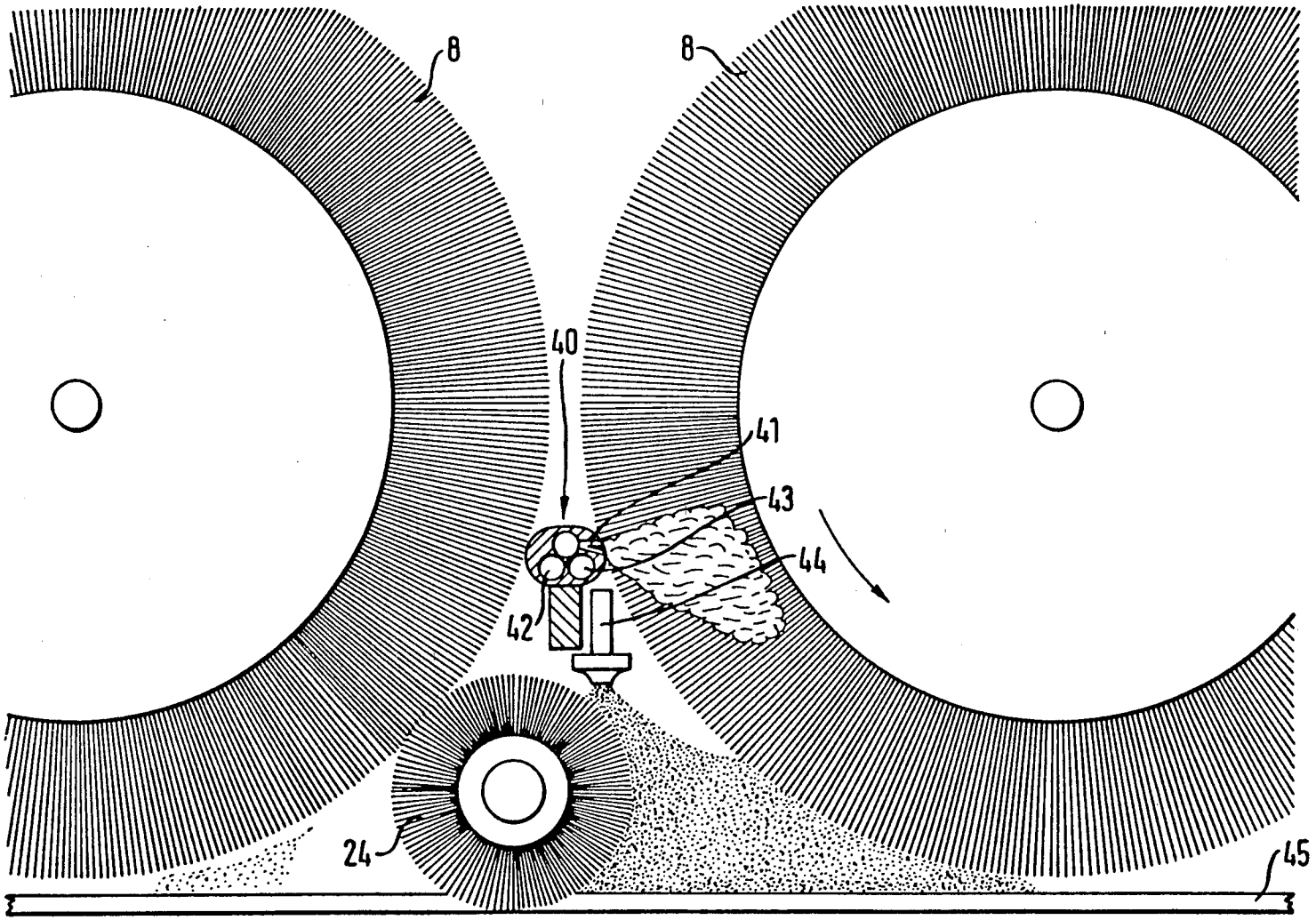
FIG. 5 is a schematic view of an embodiment variation of a system for depositing the dye liquor.

In the preferred embodiment of FIG. 5, an adding system 40 is present between every two revolving main brushes s in order to refine and hence to improve dyeing compared with that taking place in the above embodiments. In this embodiment mode, the casing of the adding system 40 comprises schematically indicated steam nozzles 41 which, in the manner shown, can be pointed toward at least one of the rotating brushes s and which are fed from a steam conduit 42, for instance a steam heating conduit. The conduit 42 also is connected to the casing of the adding system 40. In corresponding manner, the steam nozzles 41 also may be supplied alternatingly or simultaneously with saturated steam by means of a further conduit 43. Obviously too, the saturated steam can be supplied through the conduit 42.

The steam nozzles can be adjusted as required.

Also, several dye nozzles 44 are provided which may be hooked up to an omitted compressed-air line and/or which may be fed from the steam conduits 42 and 43.

The dye supply is in an omitted container shunted by the compressed-air line in the form of a venturi tube, whereby the dye shall be supplied already in atomized form to the dye nozzles 44.

As schematically shown in FIG. 5, the dye particles issue in finely dispersed form from the dye nozzles 44 and thereby they can be seized by the brushes s and 24 in the manner already described and be introduced in the fabric 45.

Figure 6:
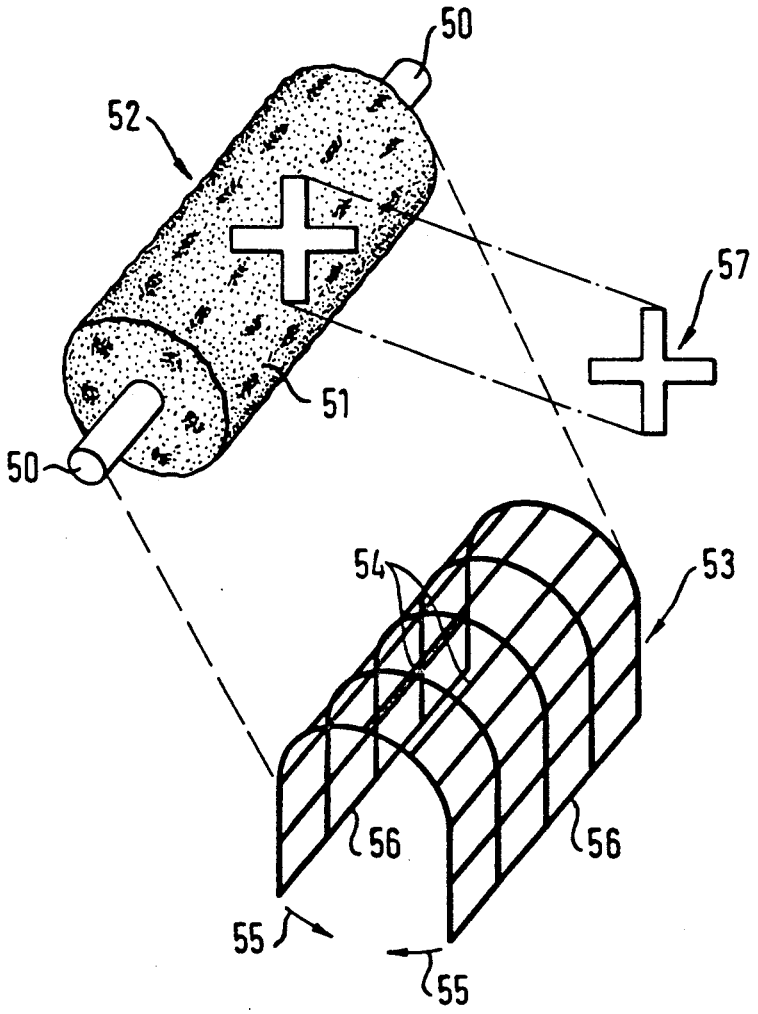
FIG. 6 is a perspective view of a preferred embodiment of a sponge roll.

FIG. 6 is a perspective of an embodiment variation where the depressing rollers 24 (FIG. 2) are not bristle-brush rollers but sponge rollers. The latter consist of a molded tubular part 51 affixed by gluing or the like to the pertinent shaft 50. The molded, tubular sponge part 51 may be seated pre-stressed on the shaft 50.

The sponge roll 52 so formed is used foremost not to wear the textile pieces being processed, but to deposit the dye in the above described manner, the sponge rolls 52 squeegee-ing and crumpling the textile pieces and thereby depositing more dye in the pleat region.

The shaft 50 can be moved closer to the conveyor belt 9, to the forward and rearward bristle rolls 1, upward, downward and laterally, in order to control the identity of dye deposition and where called for the later dissolution of the contour. Suitable adjustment devices for the shaft 50 are provided for this purpose.

Aside affixing by gluing to the shaft 50, the tubular sponge coating 51 also may be covered by a net 53 and be mounted on the shaft 50, the net if desired being coarse-meshed as shown, so that the individual meshes 54 shall reproduce on the surface of the sponge roll 52. In that case, affixing is implemented in the manner shown by the net 53 looping the sponge roll 52 in the direction of the arrows 55, with overlapping of the free ends 56 of the net 53.

Moreover and as shown by FIG. 6, specific preformed pattern implements 57 may be bodily deposited by gluing or the like or else by the net 53 simultaneously holding these patterns. In the latter case, the meshes 54 besides the pattern 57 would be reproduced on the sponge roll 52. The pattern 57 may consist of a textile, a flexible plastic or a flexible metallic material.

Instead of the deposits on the outside of the cylindrical sponge part 51, millings or impressions may be put into the surface of the spongy roll tube 51 because such recesses also shall reproduce the pattern contours.

Although particular embodiments of the present invention have been described and illustrated herein, it should be recognized that modifications and variations may readily occur to those skilled in the art and that such modifications and variations may be made without departing from the spirit and scope of the invention. Consequently, the invention as claimed below may be practiced otherwise than as specifically described above.

What is claimed is:

1. A method for dyeing textiles comprising the simultaneous steps of:

exposing a surface of said textiles to bristles of a mechanically driven brush, said bristles process said surface inducing wear and softening the fabric; and said bristles depositing a dye liquor with a diluted dye on said surface.

2. A method for dyeing textiles as defined in claim 1, wherein the dye has a concentration of 0.01 to 0.05 g/liter.

3. A method for dyeing textiles as defined in claim 1 wherein the textiles may be selected from the group consisting of finished pieces and yard goods.

4. A method for dyeing textiles as defined in claim 1, further comprising the step of impregnating the textile pieces with the dye liquor until dyeing appears on a back side of the textiles away from the brushes.

5. A method for dyeing textiles as defined in claim 1, further comprising the step of feeding the dye liquor with steam.

6. A method for dyeing textiles as defined in claim 5, wherein the steam used is saturated at a temperature of approximately 100 to 120 degrees Celsius.

7. A method of dyeing textiles as defined in claim 1, further comprising the step of collecting and returning to the dye liquor excess portions of said dye liquor that pass by the textile pieces.

* * * * *